US006669611B2

(12) United States Patent
Raymond

(10) Patent No.: US 6,669,611 B2
(45) **Date of Patent: *Dec. 30, 2003**

(54) ABDOMINAL EXERCISER DEVICE

(76) Inventor: Jean-Guy Raymond, 745, rue Batiscan, Laval, QBC (CA), H7E 4E8

( * ) Notice: Subject to any disclaimer, the term of this patent is extended or adjusted under 35 U.S.C. 154(b) by 77 days.

This patent is subject to a terminal disclaimer.

(21) Appl. No.: 09/948,912

(22) Filed: Sep. 10, 2001

(65) Prior Publication Data

US 2002/0019300 A1 Feb. 14, 2002

Related U.S. Application Data

(63) Continuation-in-part of application No. 09/502,236, filed on Feb. 11, 2000, now Pat. No. 6,309,331.

(51) Int. Cl.[7] ..... A63B 71/00
(52) U.S. Cl. ..... 482/148; 482/140; 482/132
(58) Field of Search ..... 482/148, 132, 482/140, 123, 126, 91, 121, 93, 135–137, 142; 601/19, 22, 23, 27, 63, 46, 118, 134, 151, 128, 124–125, 129, 131–132

(56) References Cited

U.S. PATENT DOCUMENTS 754,925 A 3/1904 Hanish et al.
1,257,925 A 2/1918 Kost
1,535,822 A 4/1925 Goodwin
1,936,022 A 11/1933 Hunt
1,947,042 A 2/1934 Glennan
2,466,470 A 4/1949 Norris
2,797,685 A 7/1957 Packwood
2,988,084 A 6/1961 Douglas
4,374,519 A 2/1983 Stauft
5,027,795 A 7/1991 Kato
5,105,802 A 4/1992 Pokorny
5,145,474 A 9/1992 Moore
5,702,354 A 12/1997 DeSpain et al.
5,833,587 A * 11/1998 Strong et al. ..... 482/123
6,309,331 B1 * 10/2001 Raymond ..... 482/148

* cited by examiner

*Primary Examiner*—Nicholas D. Lucchesi
*Assistant Examiner*—L Amerson

(57) ABSTRACT

An abdominal exerciser device includes a self-standing casing that freely movably supports an exercising member such as a ball with an exposed surface protruding upward from the casing for contacting a user's body part. The device also includes a hollowed cover connecting to the casing to protect the exposed surface from outside environment when the device is unused, and a handgrip for hand-carrying the same. The device can include a carrier having an adjustment member mounted thereon to adjust position of the casing relative to the carrier.

13 Claims, 4 Drawing Sheets

ABDOMINAL EXERCISER DEVICE

CROSS-REFERENCE TO RELATED APPLICATION

This application is a Continuation-In-Part (C.I.P.) of patent application Ser. No. 09/502,236, filed on Feb. 11, 2000, now U.S. Pat. No. 6,309,331.

FIELD OF THE INVENTION

The present invention relates to exercisers, and more particularly to a transportable abdominal exerciser.

BACKGROUND OF THE INVENTION

Massaging device has been disclosed in the prior art in U.S. Pat. No. 1,936,022 issued on Nov. 21, 1933 to J. V. Hunt. The device comprises a ball held in a semi-spherical frame equipped with a handle that can be manually grasped for applying pressure with the ball, for example on a person's abdominal area. A motor mounted inside a casing attached to the frame allows for vibration of the ball on the abdominal area, where an alleged fat reduction in this area. However, this apparatus is disadvantageous in that it does not fully exercise the abdominal muscles, and one is required to manually hold the device while applying pressure on his abdominal area for the device to have an effect: this can become uncomfortable and tedious, with little or no effective results in abdominal muscles strengthening.

Reducing apparatus has been disclosed in the prior art in U.S. Pat. No. 2,466,470 issued on Apr. 5, 1949 to G. G. Norris. The apparatus comprises a resilient sphere, which can be rolled on a flat surface or on a concaved transverse member disposed along a wall. Areas of the body such as hips and waist may be reduced of excessive fatness through the action of the body part while in contact with the sphere. However, the sphere of this apparatus does not have a free-rolling action and the apparatus is not stand-alone in that for the sphere to have an effect a minimum of two points of contact must be given to the sphere to keep it balanced; this requires the user to constantly change position, which can become discomforting and troublesome.

OBJECTS OF THE INVENTION

It is therefore a general object of the present invention to provide an abdominal exerciser that obviates the above noted disadvantages.

An object of the present invention is to provide an abdominal exerciser that allows for a simple way to exercise a person's abdominal muscles.

Another object of the present invention is to provide an abdominal exerciser for reducing purposes, on which a body part such as the abdomen, waist and/or hips can be applied for pressuring, massaging, rolling and pounding actions.

A further object of the present invention is to provide an abdominal exerciser to which a person can adapt various level of pressure.

A still further object of the present invention is to provide a stand alone abdominal exerciser liberating arms and legs which can be mounted at various angles on a more sophisticated structure alone or together with other similar exercisers to ease and facilitate the use by the user.

Another object of the present invention is to provide an abdominal exerciser that is easy to build, manufacture and maintain, and adaptable to various comfort level by using adaptable balls and with or without an absorbing material installed below the exerciser.

Yet another object of the present invention is to provide an abdominal exerciser that is self-contained for good protection and easy transportation.

Further objects and advantages of the invention will be in part obvious from an inspection of the accompanying drawings and a careful consideration of the following description.

SUMMARY OF THE INVENTION

The present invention consists of an abdominal exerciser device that comprises a self-standing casing member freely movably supporting an exercising member having an exposed surface protruding upward from the casing for contacting a user's body part, a hollowed cover connecting to the casing member and protecting the exposed surface from outside environment when the device is unused, and a handgrip for hand-carrying the device.

Preferably, the device includes a carrier having an adjustment member mounted thereon to adjust position of the casing member relative to the carrier.

Preferably, the adjustment member is an absorber supporting the casing member, thereby providing shock absorption and resiliency within the exerciser device.

Preferably, the casing member pivotally connects to the carrier, thus allowing for angular adjustment of the casing member relative to the carrier.

Preferably, the cover includes a locking member to lock the same to the casing member, thus preventing the exercising member from being exposed during transportation of the device.

Preferably, the carrier includes at least one caster rollably supporting the device.

Preferably, the handgrip is telescopic to extend away from the caster.

Preferably, the exercising member is a ball, the casing member has at least one substantially upwardly oriented cavity with at least three bearing members secured therein, the ball removably and partially engaging the cavity and freely rollably engaging bearing members, the exposed surface of the ball protruding out from the casing member.

Preferably, at least three bearing members are all coplanar and engaging the ball at their respective apex point and apex points forming a plane substantially intersecting the ball at a substantially mid-depth of the cavity.

Preferably, the casing member includes a top flange secured thereto and having a circular opening of a diameter slightly larger than the diameter of the ball, the opening is substantially centered with respect to bearing members, the exposed surface of the ball protruding out from the casing member through the circular opening.

Alternatively, the casing member includes a top flange secured thereto and having a circular opening of a diameter slightly smaller than the diameter of the ball, the opening is substantially centered with respect to bearing members, the exposed surface of the ball protruding out from the casing member through the circular opening.

Preferably, the casing member includes an additional substantially upwardly oriented cavities with at least three additional bearing members for each of the additional cavities and respectively secured therein, and one additional ball partially removably engaging each one of the additional cavities and freely rollably engaging its respective additional bearing members, cavities being in close proximity to each other.

Alternatively, the exercising member is a roller, the casing member has at least two bearing members secured thereto, the roller freely rollably engaging bearing members, the exposed surface of the roller radially protruding out from the casing member.

Preferably, the exposed surface has an axially curved shape.

Preferably, the casing member has additional bearing members secured thereto, said device includes an additional roller freely rollably engaging said additional bearing members and having an exposed surface radially protruding out from the casing member.

Preferably, the exercising member is made out of a resilient material.

Preferably, the carrier has a pad connected to a bottom surface thereof to prevent displacement of the carrier relative to an underlying surface.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purposes and by no means as of limitation.

Figure 1:
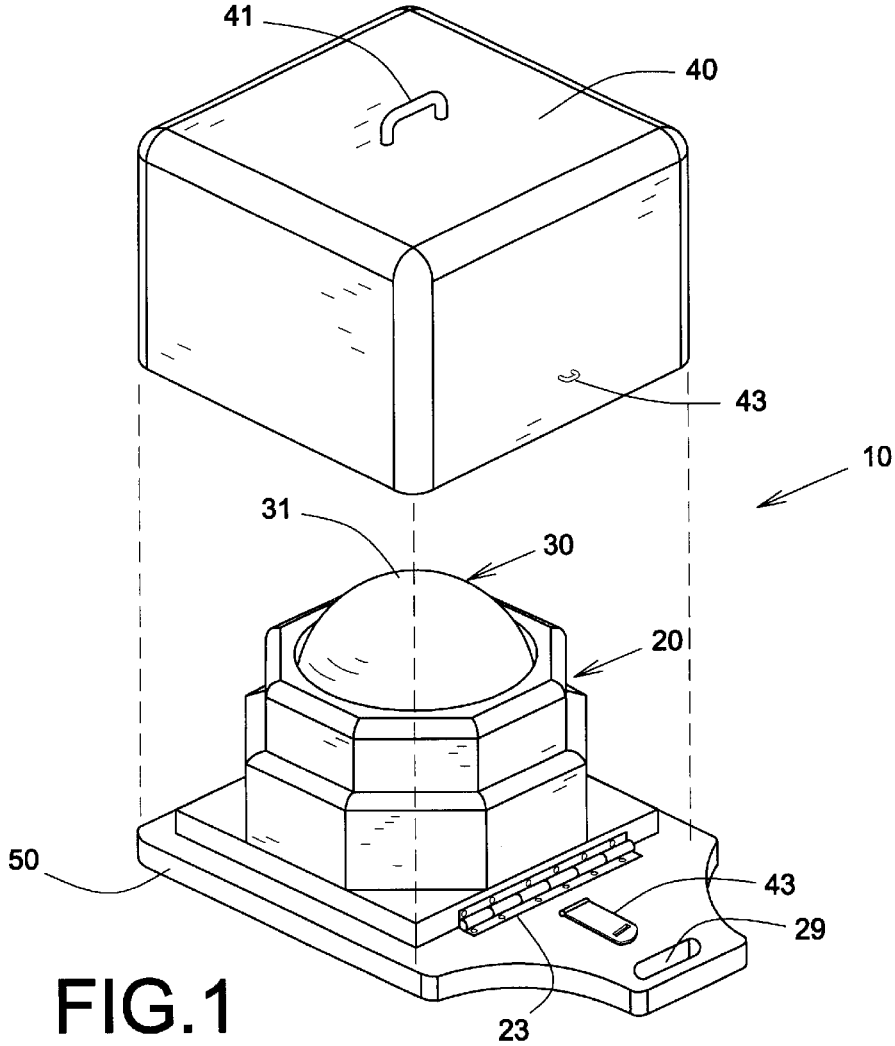
FIG. 1 is a partially exploded perspective view of an embodiment of an abdominal exerciser according to the present invention.

Referring to FIG. 1, there is shown a first embodiment 10 of an abdominal exerciser device in accordance with the present invention that includes a self-standing casing member 20 freely movably supporting an exercising member 30, preferably a ball, which has an exposed surface 31 protruding upward from the casing 20 for contacting a user's body part (not shown). The device 10 includes a hollowed removable cover 40 connected to the casing 20 to protect the exposed surface 31 from the outside environment when the device 10 is unused, and a handgrip 29 for hand-carrying the same 10. The cover 40 has a handle 41 for the user to easily install and uninstall the same from the casing 20 or, in the case the cover 40 is secured and latched to the casing 20, to carry the abdominal exerciser device 10.

Figure 2:
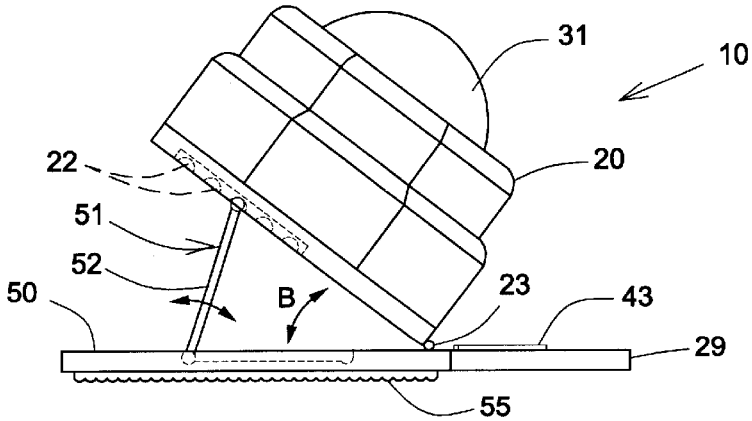
FIG. 2 is a side view of the embodiment of FIG. 1 in a tilted configuration.
Figure 2A:
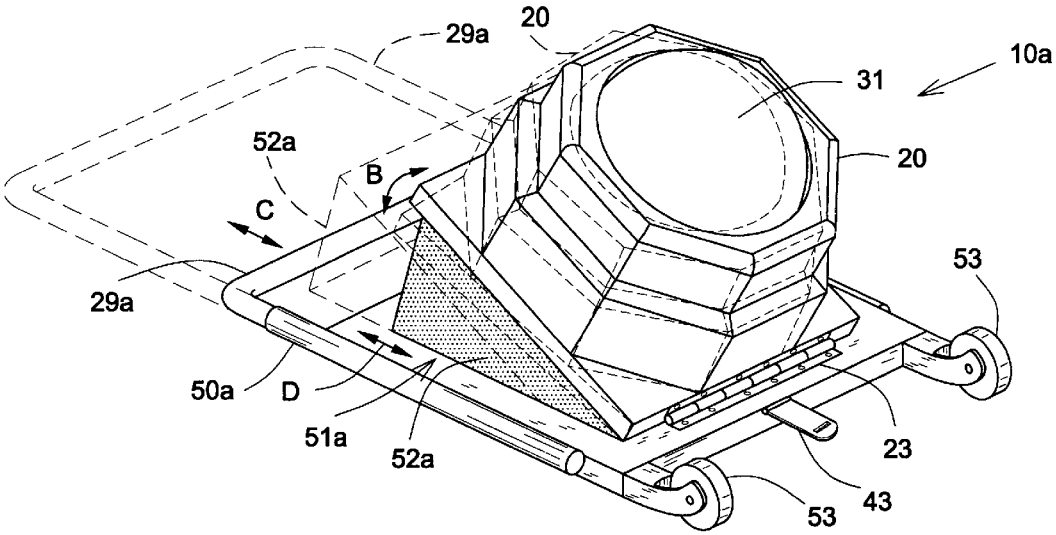
FIG. 2*a* is a perspective view of a second embodiment of an abdominal exerciser according to the present invention including an absorber material.
Figure 2B:
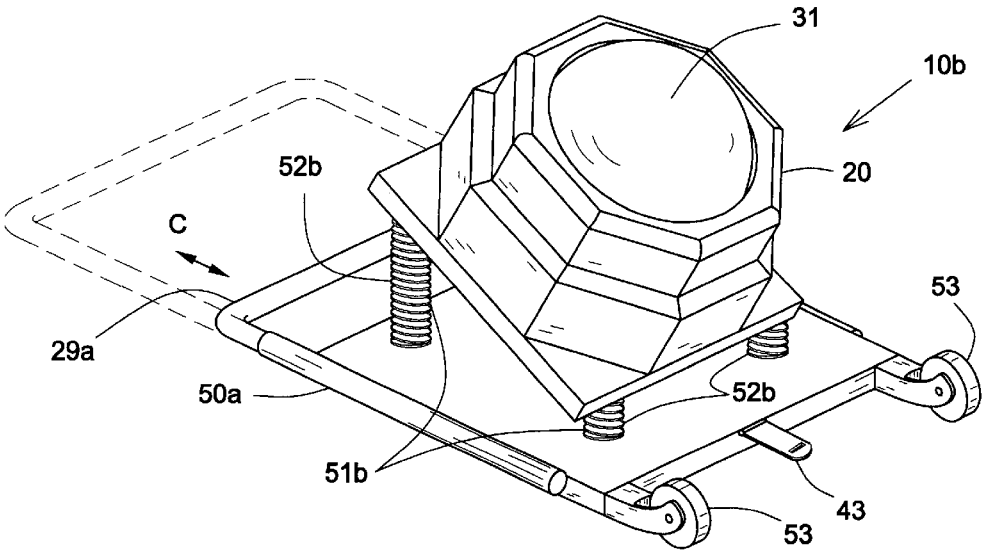
FIG. 2*b* is a perspective view similar to FIG. 2*a* of a third embodiment of an abdominal exerciser according to the present invention including a spring-type absorber.

As better illustrated in FIGS. 2, 2*a* and 2*b*, the self-standing casing 20 includes a carrier 50 with an adjustment member 51 mounted thereon to adjust the position of the casing 20 relative to the carrier 50 (indicated by arrow B in FIGS. 2 and 2*a*). In FIG. 2, the adjustment member 51 is a T-shaped support 52 pivotally mounted on the carrier 50 at one end and removably engaging different complementary recesses 22 of the casing 20 at the free other end. In FIG. 2*a*, the adjustment member 51*a* of the second embodiment 10*a* is a wedge shape absorber 52*a* displaceable in the direction indicated by arrow D to provide shock absorption and resiliency within the exerciser device 10 in the direction indicated by arrow B. The embodiment 10*b* of FIG. 2*b* illustrates another adjustment member 51*b* being at least one, preferably four, spring absorbers 52*b*.

The casing 20 preferably pivotally connects, via hinge 23, to the carrier 50 to allow for angular adjustment of the casing 20 relative to the carrier 50 (indicated by arrow B and dotted lines in FIG. 2*a*).

The cover 40 includes a locking member 43 to lock and secure the same to the casing 20 in order to prevent the exercising member 30 from being exposed to the outside environment during transportation of the device 10.

Referring to FIGS. 2*a* and 2*b*, the carrier 50*a* includes at least one caster 53, preferably two, to rollably support the device 10. Also the carrier 50*a* includes a different handgrip 29*a* that is preferably telescopic to extend away (arrow C) from the casters 53 for the user to rollably displace the device 10 in the same manner as if it would be a conventional carry-on baggage with wheels.

Figure 3:
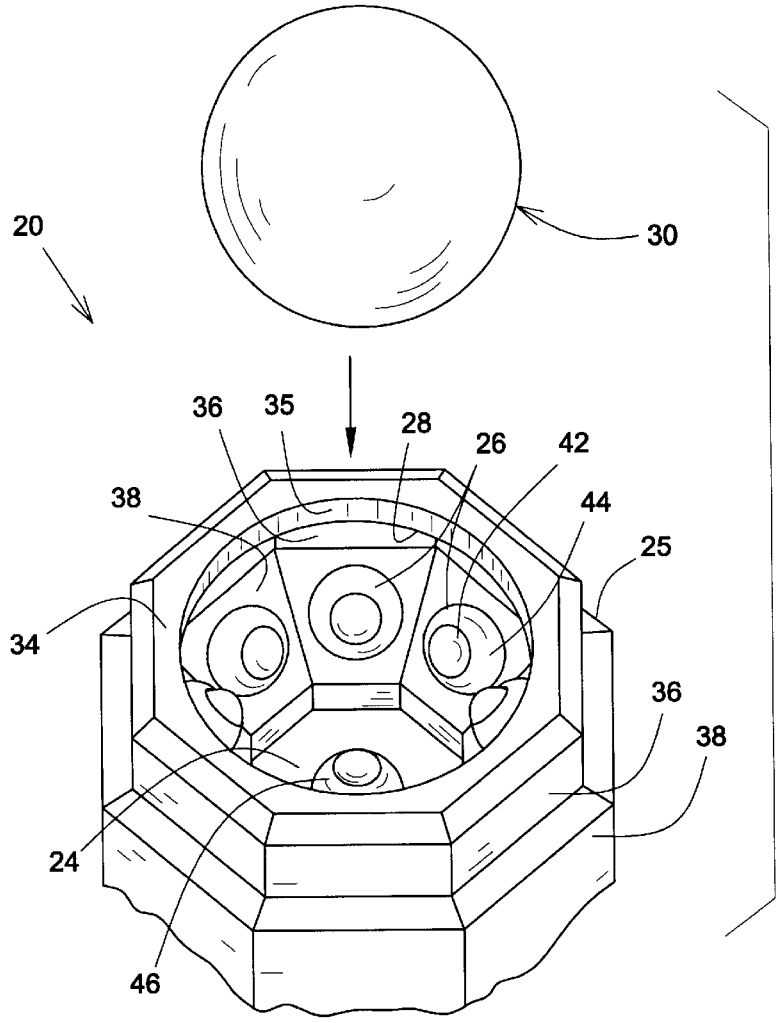
FIG. 3 is an exploded broken top perspective view of the casing of the embodiment of FIG. 1.

As is shown in FIGS. 1 to 3, the casing 20 has a substantially upwardly oriented cavity 28 with at least three bearing members 26 secured therein, the ball 30 removably and partially engages the cavity 28 and freely rollably engages the bearing members 26.

At least three, preferably eight, bearing members 26 (see FIG. 3) are coplanar, and engage the ball 30 at the apex points that form a plane substantially intersecting the ball 30 at substantially mid-depth of the cavity 28.

The casing 20 includes a top flange 34 secured thereto that has a circular opening 35 of a diameter preferably slightly larger than the diameter of the ball 30, the opening 35 is substantially centered with respect to bearing members 26. The exposed surface 31 of the ball 30 protrudes out from the casing 20 through the circular opening 35.

Figure 4:
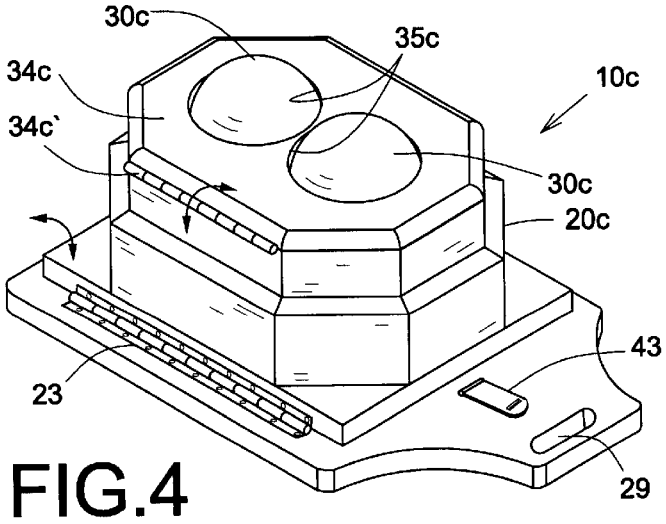
FIG. 4 is a perspective view of a third embodiment of an abdominal exerciser according to the present invention, showing a casing supporting two balls and having a removable top flange.

Alternatively, as illustrated in the fourth embodiment 10*c* of FIG. 4, the circular opening 35*c* can have a diameter slightly smaller than the diameter of the ball 30*c* to retain the ball 30*c* into the cavity 28 of the casing 20*c*. In this case, the top flange 34*c* is movably connected to the casing 20*c*, via hinge 34*c*', to allow for the balls 30*c* to be removed from the casing 20*c* to be cleaned or replaced whenever required.

Furthermore, the casing 20*c* includes an additional substantially upwardly oriented cavity 28 with at least three additional bearing members 26 (preferably similar to the ones-is illustrated in FIG. 3) for the additional cavity 28 and respectively secured therein, and an additional ball 30*c* partially removably engaging the same. The two cavities 28 are in close proximity to each other.

Figure 5A:
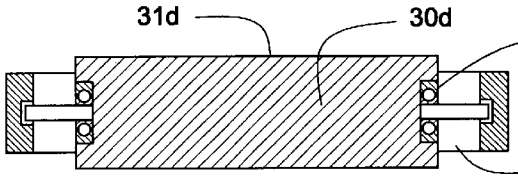
FIG. 5*a* is a section view taken along line 5*a*—5*a* of FIG. 5.
Figure 5B:
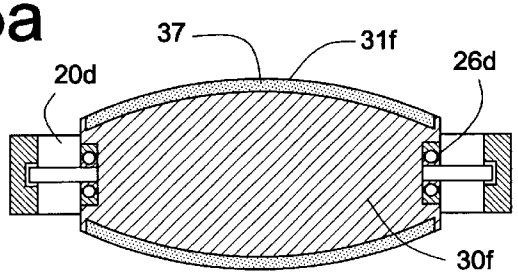
FIGS. 5*b*, 5*c* and 5*d* are views similar to FIG. 5*a*, showing different embodiments of the roller.
Figure 5C:
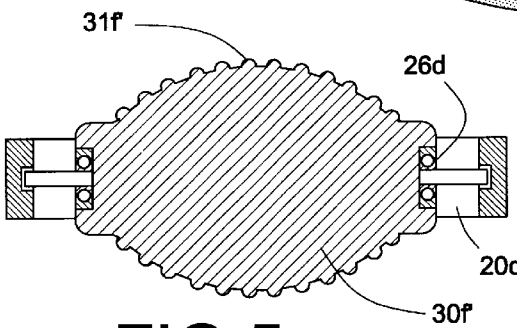
Figure 5D:
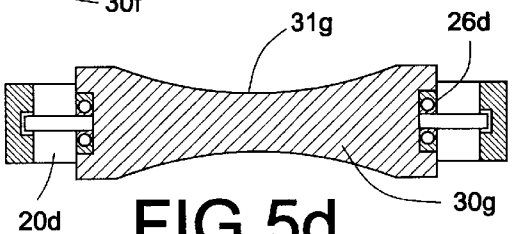
Figure 5:
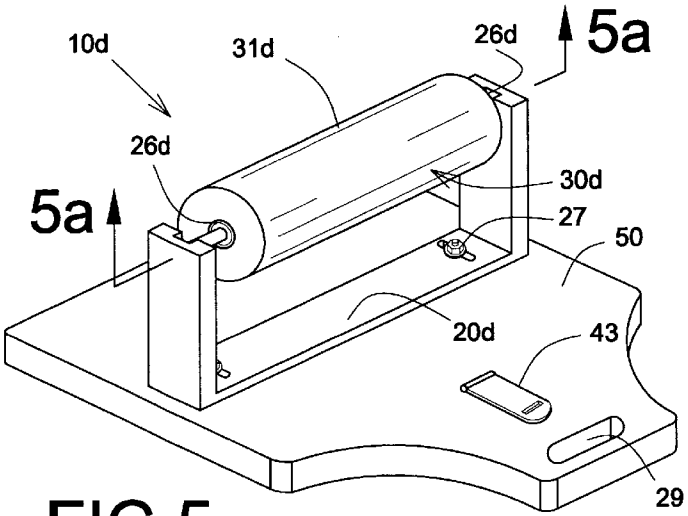
FIG. 5 is a perspective view of a fourth embodiment of an abdominal exerciser according to the present invention, showing a roller as the exerciser member.

Referring to FIGS. 5 and 5*a*, the exercising member 30*d* of the fourth embodiment 10*d* is a roller. The casing 20*d* has at least two bearing members 26*d* secured thereto. The roller 30*d* freely rollably engages the bearing members 26*d* and has an exposed surface 31*d* radially protruding out from the casing 20*d*.

The exposed surface 31*d* can have an axially curved shape 31*f*, 31*f'* or 31*g* (see FIGS. 5*b*, 5*c* or 5*d* respectively) in which the radius varies along the axis of the roller 30*f*, 30*f'* or 30*g*. The exposed surface 31*f* can be covered with a resilient material 37 or coating as is illustrated in FIG. 5*b*, or have small dents 31*f'* as is illustrated in FIG. 5*c* to make it non-smooth for different massage sensations.

Referring to FIG. 5, the casing 20*d* is slidably adjustable relative to the carrier 50 via adjusting elements 27.

Figure 6:
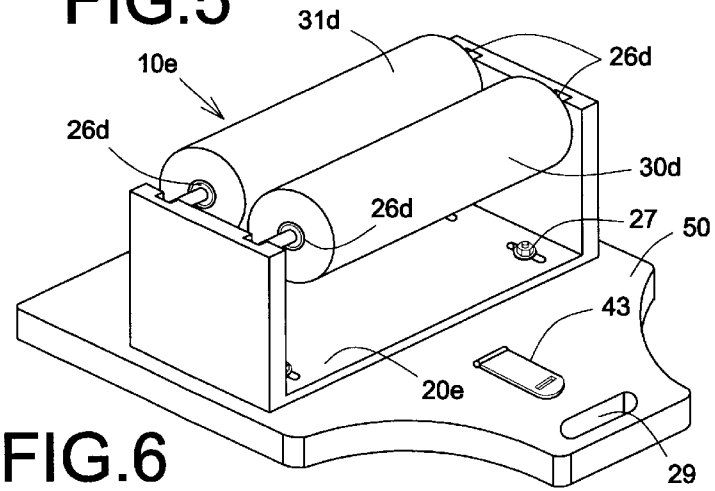
FIG. 6 is a perspective view similar to FIG. 5, showing a fifth embodiment of an abdominal exerciser according to the present invention with two parallel rollers.

Referring to FIG. 6, the casing 20*e* includes additional bearing members 26*d* adjustably secured thereto and an additional roller 31*d*, preferably parallel to the other, freely rollably engaging the additional bearings 26*d*. The exposed surface 31*d* of the additional roller 30*d* radially protrudes out from the casing 20*e*.

Preferably, the exercising member 30 is made out of a resilient material.

The carrier 50 preferably has an anti-squid pad 55, coating or mounting feet, (see FIG. 2) connected to a bottom thereof to prevent displacement of the carrier 50 relative to an underlying floor surface.

Referring to FIG. 3, the abdominal exerciser 10 has the self-standing base portion or casing 20 that includes a lower plate 24 and sidewalls 25 secured substantially perpendicularly to the lower plate 24.

The lower plate 24 and sidewalls 25 form a substantially upwardly oriented cup shaped cavity 28 adapted to be removably engaged by a ball 30, preferably made out of resilient rubber. The cavity 28 has a generally circular opening 35 with a diameter slightly larger than the diameter of the ball 30 for engagement therein of the latter. Preferably, the opening 35 is part of a flange 34 secured on its outer edge to the contour of the sidewalls 25.

The combined height of the sidewalls 25 and the flange 34 is substantially equal to or slightly larger than the radii of the resilient rubber ball 30. The sidewalls 25 is a multi-sided wall including a generally vertical upper section 36 covering approximately half of the depth of the cavity 28 and terminated at the top by the flange 34, and a substantially internally conical lower section 38 between the upper section 36 and the plate 24 and covering the other half. Preferably, eight bearing members 26 (not shown), each including a support 42 and its bearing 44, are mounted onto the lower section 38 of sidewalls 25. The bearings 26 are peripherally equally spaced and all on a same plane.

Once engaged into the cavity 28, the resilient rubber ball 30 is rollably supported solely by the bearings 26 and therefore permitted to freely rollover itself. Each bearing 26 engages the ball 30 at its own apex point; all apex points forming a plane intersecting the ball 30 between 30% an 70% of the radii, preferably at mid radii. The intersecting plane is essentially parallel to the opening 35.

The resilient rubber ball 30 is preferably released from the casing 20 since the circumference of the opening 35 of the top flange 34 is always slightly larger than the circumference of the ball 30 and since the vertical height (or depth) of the combination of the top flange 34 and the cavity 28 is only slightly higher than half the diameter of the ball 30. The ball 30 may be alternatively made out of a relatively soft material or a hard material, but in any event, it must be prevented from excessive deformation upon being loaded with a user's weight as described hereinafter, since it must still be allowed to rollover itself when rollably engaging the bearings 26.

In preference, the ball 30 has a diameter of between five (5) inches to ten (10) inches, preferably eight (8) inches, and weighs between one (1) kg and eight (8) kg, such as conventional medicine balls.

The angle of the lower section 38 of the sidewalls 25 is preferably of forty-five (45) degrees, but could vary. The depth at which, for example, the eight bearings 26 are positioned inside the cavity 28 will depend of the angle position of that lower section 28, but should allow for a contact at between 30% and 70% of the radii of the ball 30.

If the abdominal exerciser 10 is positioned at an angle of up to approximately forty-five (45) degrees from horizontal, the ball 30 should still only rest on the bearings 26, depending at which exact depth the latter are positioned, not affecting its use. If the angle of the abdominal exerciser 10 is increased to approximately between forty-five (45) degrees and ninety (90) degrees, the ball 30, depending at which exact depth the bearings 26 will be positioned, will also have contact with the inner edge of opening 35, thus preventing the ball 30 from rolling over itself while supported by the bearings 26.

It may however still be possible to use the abdominal exerciser 10 under these circumstances when instead of being in contact with the inner edge of the opening 35 the ball 30 is in contact with a region of the user's body and enough pressure is applied onto the ball 30. If the abdominal exerciser 10 is positioned at angles between ninety (90) degrees and one hundred and eighty (180) degrees and no pressure is applied onto the ball 30, the latter will fall under gravity. Ultimately, it may however still be possible, but not practical, to use the abdominal exerciser 10 using the same principle as explained above when the angle varies between forty-five (45) degrees and ninety (90) degrees.

For better ball 30 support within the cavity 28, a bottom bearing member 46 may be secured at a proper level at the closed end of the cavity 28, on the lower plate 24.

Alternatively, the top flange 34 is releasably secured to the casing 20 and its opening 35 has a diameter smaller than the diameter of the ball 30 in order to retain the latter 30 inside the casing 20 when the device 10 is tilted by ninety (90) degrees or even turned up-side-down. Obviously, the depth of the cavity 28 is less than the radii of the ball 30 while the depth of the combination of the cavity with the flange 34 is more than the radii of the ball 30.

The abdominal exerciser 10 of FIGS. 1 to 6 respectively are transportable and are typically used while simply laying down on the floor with the user's abdominal muscles laid down and applying pressure on the ball 30 or on the roller 30*d* that is upwardly oriented. The user then puts more or less pressure, using his/her own weight, on different part of his abdominal muscles by moving his body using the balance provided by his legs and arms.

The feet and hands of the user are primarily used as balancing devices rather than the possible support devices since they are in direct contact with the floor. By tilting his body on one side or the other on the ball 30 or on the roller 30*d* the latter is free to move since it sits on bearings 26, 26*d*. This tilting motion of the body will effectively allow different muscles of the user's abdominal region to be exercised. Different resilient rubber balls 30 or rollers 30*d* may be used according to the desired level of abdominal training the user wishes, small and hard balls 30 or rollers 30*d* requiring more effort than large and soft balls 30 or roller 30*d*.

It is also of importance when practicing such an exercise that when a person tilts his body laterally on the ball 30 or roller 30*d*, the casing 20 or 20*d* does not hinder this tilting motion.

All the above described exerciser 10 are specifically used to reinforce, train or make firmer the different muscles of the waist, hip and abdominal body parts of the user.

The self-standing casing 20 and the cover 40 may have pictorial ornamentation and be made out of transparent type of material.

The adjustment member 51 may be motorized (different types of vibrators, dampers or the like) that can generate variable resistance levels (not shown).

All embodiments of the exercising member 30 may be inflatable to provide different resiliency levels to the abdominal exerciser users.

It is to be noted that the cover 40 is not shown in FIGS. 2 to 6 for clarity purposes.

Although the present abdominal exerciser device has been described with a certain degree of particularity, it is to be understood that the disclosure has been may of example only and that present invention is not limited to the features of the embodiments described and illustrated herein, but includes all variations and modifications within the scope of the present invention as hereinafter claimed.

I claim:

1. An abdominal exerciser device comprising a self-standing casing member freely movably supporting an exercising member having an exposed surface protruding upward from said casing for contacting a user's body part, a hollowed cover connecting to said casing member and protecting said exposed surface from outside environment when said device is unused, and a handgrip for hand-carrying said device.

2. The device of claim 1, including a carrier having an adjustment member mounted thereon to adjust position of said casing member relative to said carrier.

3. The device of claim 2, wherein said casing member pivotally connecting to said carrier, thus allowing for angular adjustment of said casing member relative to said carrier.

4. The device of claim 1, wherein said cover including a locking member to lock the same to said casing member, thus preventing said exercising member from being exposed during transportation of said device.

5. The device of claim 2, wherein said carrier including at least one caster rollably supporting said device.

6. The device of claim 5, wherein said handgrip being telescopic to extend away from said caster.

7. The device of claim 1, wherein said exercising member being a ball, said casing member having at least one substantially upwardly oriented cavity with at least three bearing members secured therein, said ball removably and partially engaging said cavity and freely rollably engaging said bearing members, said exposed surface of said ball protruding out from said casing member.

8. The device of claim 7, wherein said at least three bearing members are all coplanar, said bearing members engaging said ball at their respective apex point and said apex points forming a plane substantially intersecting said ball at a substantially mid-depth of said cavity.

9. The device of claim 7, wherein said casing member includes a top flange secured thereto and having a circular opening of a diameter slightly larger than the diameter of said ball, said opening being substantially centered with respect to said bearing members, said exposed surface of said ball protruding out from said casing member through said circular opening.

10. The device of claim 7, wherein said casing member includes a top flange secured thereto and having a circular opening of a diameter slightly smaller than the diameter of said ball, said opening being substantially centered with respect to said bearing members, said exposed surface of said ball protruding out from said casing member through said circular opening.

11. The device of claim 7, wherein said casing member includes an additional substantially upwardly oriented cavities with at least three additional said bearing members for each of said additional cavities and respectively secured therein, and one additional ball partially removably engaging each one of said additional cavities and freely rollably engaging its respective additional bearing members, said cavities being in close proximity to each other.

12. The device of claim 1, wherein said exercising member being made out of a resilient material.

13. The device of claim 2, wherein said carrier having a pad connected to a bottom surface thereof to prevent displacement of said carrier relative to an underlying surface.

* * * * *